United States Patent [19]

Amano et al.

[11] Patent Number: 4,543,937

[45] Date of Patent: Oct. 1, 1985

[54] METHOD AND APPARATUS FOR CONTROLLING FUEL INJECTION RATE IN INTERNAL COMBUSTION ENGINE

[75] Inventors: Hidetoshi Amano, Okazaki; Shinichi Abe; Mitsuharu Taura, both of Toyota; Toshiaki Mizuno, Nagoya, all of Japan

[73] Assignees: Toyota Jidosha Kabushiki Kaisha, Toyota; Nippondenso Co., Ltd., Kariya, both of Japan

[21] Appl. No.: 588,101

[22] Filed: Mar. 9, 1984

[30] Foreign Application Priority Data

| | | | |
|---|---|---|---|
| Mar. 15, 1983 | [JP] | Japan | 58-43457 |
| Mar. 15, 1983 | [JP] | Japan | 58-43458 |
| Apr. 19, 1983 | [JP] | Japan | 58-68753 |

[51] Int. Cl.[4] ..... F02M 51/00

[52] U.S. Cl. ..... 123/491; 123/492

[58] Field of Search ..... 123/491, 492, 480, 493, 123/179 L

[56] References Cited

U.S. PATENT DOCUMENTS

| | | | |
|---|---|---|---|
| 4,193,380 | 3/1980 | Marchak et al. | 123/491 |
| 4,239,022 | 12/1980 | Drews et al. | 123/491 |
| 4,364,363 | 12/1982 | Miyagi et al. | 123/492 |
| 4,436,073 | 3/1984 | Miyagi | 123/491 |
| 4,437,445 | 3/1984 | Takahashi et al. | 123/491 |
| 4,438,748 | 3/1984 | Ikeura et al. | 123/491 |
| 4,462,375 | 7/1984 | Isobe et al. | 123/491 |
| 4,463,732 | 8/1984 | Isobe et al. | 123/491 |

*Primary Examiner*—Parshotam S. Lall

*Attorney, Agent, or Firm*—Cushman, Darby & Cushman

[57] ABSTRACT

The basic fuel injection time duration or the basic injector opening time is computed on the basis of an intake pressure and an engine speed. A start temperature correction value is selected on the basis of the engine temperature at the time of or immediately after the start up of the engine and attenuated in accordance with the time elapsed after the start up of the engine, such that, the lower the engine temperature is at the time of start up, the greater the start temperature correction value is. The rate of fuel injection rate is controlled by correcting the basic fuel injection time on the basis of the start temperature correction value and a condition of the engine.

21 Claims, 24 Drawing Figures

METHOD AND APPARATUS FOR CONTROLLING FUEL INJECTION RATE IN INTERNAL COMBUSTION ENGINE

BACKGROUND OF THE INVENTION

1. Field of the Invention

The present invention relates to a method and apparatus for controlling the rate of fuel injection in internal combustion engine. More particularly, the invention is concerned with a method and apparatus for controlling the rate of fuel injection in an internal combustion engine having an intake passage, of a comparatively large length and a fuel injector adapted to inject fuel into the intake passage, so that the fuel is mixed with the intake air thereby forming an air-fuel mixture which is then induced into the combustion chambers of the engine.

2. Description of the Prior Art

Modern internal combustion engines of the type described above incorporate electronic fuel injection controllers. The electronic fuel injection controller is adapted to compute the basic fuel injection time duration, i.e. the basic valve opening time, in accordance with data such as, for example, absolute pressure in the intake pipe and engine speed, and to make various correction computations in accordance with the condition of the engine including the warming-up of the engine, transient state and so forth to determine the final fuel injection time duration. In operation, the fuel injector is opened at each one of predetermined crank angles to achieve so-called synchronous injection.

The correction which is conducted in accordance with the state of warming-up of the engine is usually referred to as "warm-up incremental correction". When the cooling water temperature of the engine is below 70° C. for example, the warm-up incremental correction is made by measuring the instant cooling water temperature by multiplying the basic injection time by a warm-up incremental coefficient which is beforehand determined in relation to the cooling water temperature in such a manner that the coefficient value becomes smaller as the engine cooling water temperature gets higher.

On the other hand, a fuel injection control referred to as "warm-up acceleration incremental correction" is conducted when the engine is accelerated during warming-up, in accordance with the following process. The amount of the acceleration is determined, for example, as the amount of change in the intake pressure. A first value correction coefficient is selected in accordance with the measured value of the amount of change in the intake pressure. Then, a second value correction coefficient is determined in accordance with the measured water temperature. The basic injection time duration is corrected using a warm-up acceleration incremental coefficient which is determined on the basis of the first and second value correction coefficients.

When the engine is accelerated quickly between the successive synchronous injections, the response of the engine will be impaired if any fuel injection is not made until the aforementioned synchronous injection is effected. Therefore, in some engines, the fuel injection is made regardless of the crank angle when a need for quick acceleration of the engine is detected. This injection is referred to as "asynchronous injection". The rate of fuel injection during asynchronous injection is determined in accordance with the degree of acceleration of the engine and the cooling water temperature. For instance, asynchronous basic injection time duration, which takes a greater value as the degree of engine acceleration is large, is determined in accordance with the detected degree of engine acceleration and the value of the determined asynchronous injection basic time duration is corrected in view of the cooling water temperature, thereby determining the final asynchronous injection time duration. The correction in view of the cooling water temperature is intended to improve the transient response characteristics of the engine by increasing the fuel injection rate in the cold state of the engine in which the fuel can hardly be evaporated.

In the internal combustion engine of the kind described, the evaporation of fuel depends on the temperature of the wall defining the intake passage between the fuel injector and the combustion chamber. From this point of view, it is preferred that the temperature of the wall surface of the intake passage between the fuel injector and the combustion chamber provide more relevant information as to the basis for various correcting operations, such as the warm-up incremental correction for determining the increment of fuel injection in accordance with the state of warming up of the engine, the determination of the increment for acceleration during warming up by the use of the second coefficient mentioned before, and the temperature compensation in the asynchronous injection. Namely, in the cold state of the engine, the evaporation of the fuel takes place only at a small rate. The increase of the fuel injection in the cold state, therefore, is made to ensure a sufficient amount of fuel to be induced into the engine thereby stabilizing the engine operation. As a matter of fact, however, the evaporation rate of fuel is directly affected by the temperature of the wall surface of the intake passage between the fuel injector and the combustion chamber of the engine. This is the reason why the various correcting operations in relation to temperature should be made on the basis of the temperature of the wall surface of the intake passage.

The second correction coefficient also is incorporated in view of the smaller fuel evaporation rate in the cold state of the engine, than in the normal operating condition of the engine. In the correcting operation making use of the second coefficient, therefore, it is preferable to use the temperature of the intake passage wall as the basis for the correction.

During the warming up of the engine at an extremely low ambient air temperature, the rise of the temperature of the intake passage wall downstream from the fuel injector lags behind the rise of the water temperature for a long period of time, so that the fuel evaporation rate is kept small for a considerably long time. Under such a condition, even when the asynchronous injection is made to cope with a demand for quick engine acceleration, the engine cannot respond to this demand because only a small amount of fuel is induced into the combustion chamber.

Thus, in the known electronic fuel injection controller in which the warm-up incremental correction, warm-up acceleration incremental correction, by the use of the second coefficient, and the asynchronous fuel injection are made on the basis of the cooling water temperature, it is impossible to optimize the rate of fuel supply to the combustion chamber. As a result, the driveability of the engine is possibly impaired, because the temperature rise of the intake passage wall downstream from the fuel injector lags behind the rise of the cooling water temperature for a long period of time, particularly during the warming up of the engine at extremely low ambient air temperature.

To obviate this problem, it has been proposed to circulate the heated cooling water through a riser formed on the outer wall surface of the intake passage to heat up the intake passage wall and, hence, the fuel thereby promoting the evaporation of the fuel. This proposal, however, cannot perfectly eliminate the above-stated problem, particularly when the ambient air temperature is very low.

SUMMARY OF THE INVENTION

Accordingly, it is a primary object of the invention to improve the driveability of the engine during warming up, particularly when the ambient air temperature is extremely low, thereby overcoming the above-described problem in the prior art.

It is a second object of the invention to improve the acceleration performance of the engine during warming up to overcome the above-described problem in the prior art.

The present inventors have confirmed through experiments that the engine temperature at the time of start up and, more precisely, the temperature of the intake air are the factors which materially determine the time length required for heating the intake passage wall surface, between the fuel injector and the combustion chamber, up to a predetermined temperature. The present invention has been accomplished on the basis of this discovery.

More specifically, according to one aspect of the invention, there is provided a method of controlling the rate of fuel injection in an internal combustion engine, the internal combustion engine having a fuel injector adapted to inject a fuel into an intake passage so as to be mixed with the intake air, thereby forming an air-fuel mixture which is then induced into a combustion chamber of the engine over a comparatively long distance along the intake passage. The method comprises the steps of: computing, in accordance with the engine speed and the load on the engine, a basic injection time duration for injecting the fuel in synchronism with the crank rotation angle; and correcting the basic injection time duration, i.e. the rate of synchronous fuel injection, during warming up of the engine by using, at least, a start temperature correction value which is selected in accordance with a first engine temperature detected at the time of start up of the engine and attenuated thereafter in accordance with the time elapsed after the start up of the engine, and a warm-up correction coefficient which is selected in accordance with a second engine temperature detected during the operation of the engine.

According to a second aspect of the invention, there is provided a method of controlling the fuel injection rate in an internal combustion engine, the internal combustion engine having a fuel injector adapted to inject a fuel into an intake passage so as to be mixed with the intake air, thereby forming an air-fuel mixture which is then induced into a combustion chamber of the engine over a comparatively long distance along the intake passage, the method comprising the steps of: computing, in accordance with the engine speed and the load on the engine, a basic injection time duration for injecting the fuel in synchronism with the crank rotation angle; and correcting the basic injection time duration, i.e. the rate of synchronous fuel injection, during acceleration of the engine while the same is being warmed up, by using, at least, a start temperature correction value which is selected in acordance with the engine temperature at the time of or immediately after the start up of the engine and attenuated thereafter in accordance with the time elapsed after the start up of the engine, a first warm-up acceleration correction coefficient selected in accordance with the degree of acceleration of the engine, and a second warm-up correction coefficient selected in accordance with the engine temperature during the operation of the engine.

According to a third aspect of the invention, there is provided a method of controlling the fuel injection rate in an internal combustion engine, the internal combustion engine having a fuel injector adapted to inject a fuel into an intake passage so as to be mixed with the intake air, thereby forming an air-fuel mixture which is then induced into a combustion chamber of the engine over a comparatively long distance along the intake passage, the method comprising the steps of: computing, in accordance with the engine speed and the load on the engine, a basic injection time duration; determining a start temperature correction value which is selected on the basis of the engine temperature at the time of or immediately after the start up of the engine and attenuated in accordance with the time elapsed after the start up of the engine, such that, the lower the engine temperature is at the time of start up, the greater the start temperature correction value is, and controlling the rate of asynchronous fuel injection conducted asynchronously with the crank rotation angle, in accordance with both the start temperature correction value and the condition of acceleration of the engine.

The invention as summarized above can produce a remarkable effect in that the acceleration characteristics of the engine are remarkably improved, particularly when the ambient air temperature is very low, without necessitating the detection of the temperature of the intake passage wall surface between the fuel injector and the combustion chamber and without being accompanied by problems such as an addition of a sensor, wiring or increasing the number of terminals of the control circuit.

These and other objects, features and advantages of the invention will become clear from the following description of the preferred embodiments taken in conjunction with the accompanying drawings.

DESCRIPTION OF THE PREFERRED EMBODIMENTS

Preferred embodiments of the invention will be described hereinunder with reference to the accompanying drawings.

Figure 1:
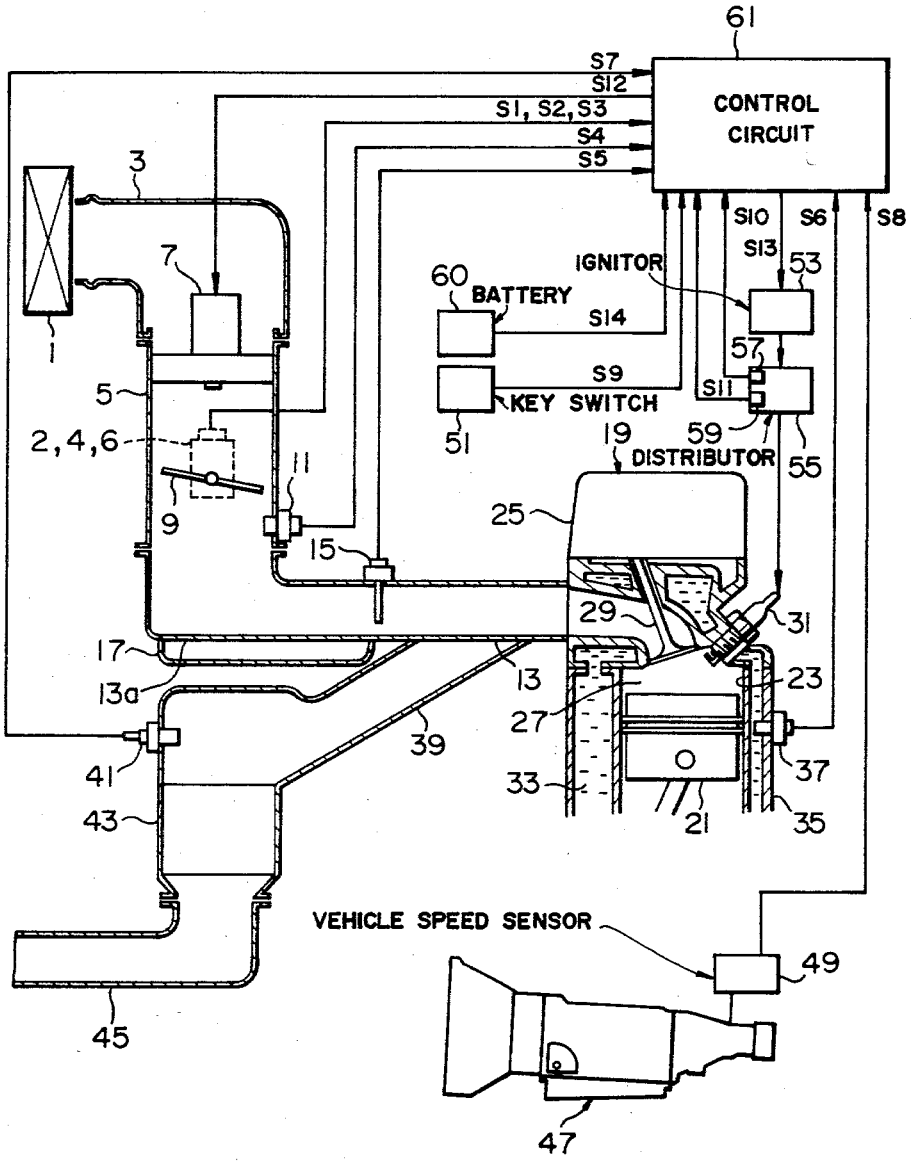
FIG. 1 is a schematic block diagram of an automotive internal combustion engine to which the present invention is applied.

FIG. 1 shows the construction of an automotive internal combustion engine incorporating an electronic fuel injection controller in accordance with the invention. Referrning to this Figure, an air filter 1 is connected to the throttle body 5 through an inlet pipe 3. The throttle body 5 is provided at its upstream side with a fuel injector 7. An intake throttle valve 9 disposed at the downstream side of the fuel injector 7 is operatively connected to an acceleration pedal (not shown) so as to control the intake air flow rate in accordance with the position of the accelerator pedal (not shown). An absolute intake pressure sensor 11 disposed at the downstream side of the intake throttle valve 9 is adapted to sense the absolute pressure of the intake air at that portion. The intake throttle valve 9 is associated with various other parts such as the valve open position sensor for measuring the opening degree of the intake throttle valve 9, an idle switch 4 which takes on position only when the intake throttle valve 9 is fully closed, and a power switch 6 which is kept in on state when the opening degree of the intake throttle valve 9 exceeds a predetermined value such as, for example, 40°.

The throttle body 5 is connected to an intake manifold 13 having branch pipes leading to respective cylinders of the engine. The intake manifold 13 is provided with an intake air temperature sensor 15 adapted to sense the temperature of the intake air in the intake manifold 13. The intake manifold 13 is provided, on the bottom wall 13*a* at the upstream side of the branching point, with a riser portion 17 through which heated cooling water is circulated to heat the air-fuel mixture through the wall of the intake manifold.

A reference numeral 19 designates the body of the engine which is known per se. The engine is provided with a plurality of clinders 23, pistons 21 and cylinder heads 25 which in combination define combustion chambers 27 (only one of which is shown). Each cylinder is provided with an intake valve 29 through which the air-fuel mixture is introduced into the combustion chamber 27. The mixture is then ignited by a spark plug 31. During operation, the cylinder 23 and other associated parts are cooled by cooling water which is circulated through a water jacket 33 formed around the cylinder 23. The temperature of the cooling water in the water jacket 33 is sensed by a cooling water temperature sensor 37 atached to the outer wall of the clinder block 35.

Branch pipes of an exhaust manifold 39 are connected to the exhaust ports (not shown) formed in the cylinder heads 25 of respective cylinders 23. The exhaust manifold 39 is provided at its downstream end portions with $O_2$ sensors 41 adapted to sense the residual oxygen content in the exhaust gas. The exhaust manifold 39 is connected to an exhaust pipe 45 through a ternary catalyst 43.

The speed of the automobile is sensed by a vehicle speed sensor 49 which is attached to the final output shaft of a transmission 47 coupled to the body 19 of the engine. Reference numerals 51, 53 and 55 denote, respectively, a key switch, igniter and a distributer. The distributor 55 is provided with an Ne sensor 57 adapted to produce an on-off signal for each angle $\theta 1$ of crank rotation. It is possible to detect the engine speed and desired angular position of the crank from the output of the Ne sensor 57. A G sensor 59 which also is provided in the distributor 55 produces an on-off signal for each angle $\theta 2$ of crank rotation greater than the above-mentioned angle $\theta 1$. The discrimination or identification of the cylinders and detection of the top dead centers are made by processing the output signal from the G sensor 59. A reference numeral 60 designates a battery.

A control circuit 61 is connected to various sensors such as the valve position sensor 2, idle switch 4, power switch 6, intake pressure sensor 11, intake air temperature sensor 15, cooling water temperature sensor 37, $O_2$ sensor 41, vehicle speed sensor 49, key switch 51, Ne sensor 57, G sensor 59 and the battery 60. Thus, the control circuit 61 receives from these sensors various signals such as a throttle valve opening degree signal S1, idle signal S2, power signal S3, intake pressure signal S4, intake air temperature signal S5, water temperature signal S6, air-fuel ratio signal S7, vehicle speed signal S8, start signal S9, engine speed signal S10, cylinder identification signal S11 and the battery voltage signal S14. The control circuit 61 is connected also to the fuel injector 7 and the igniter 53 so that it can produce a fuel injection signal S12 and an ignition signal S13.

Figure 2:
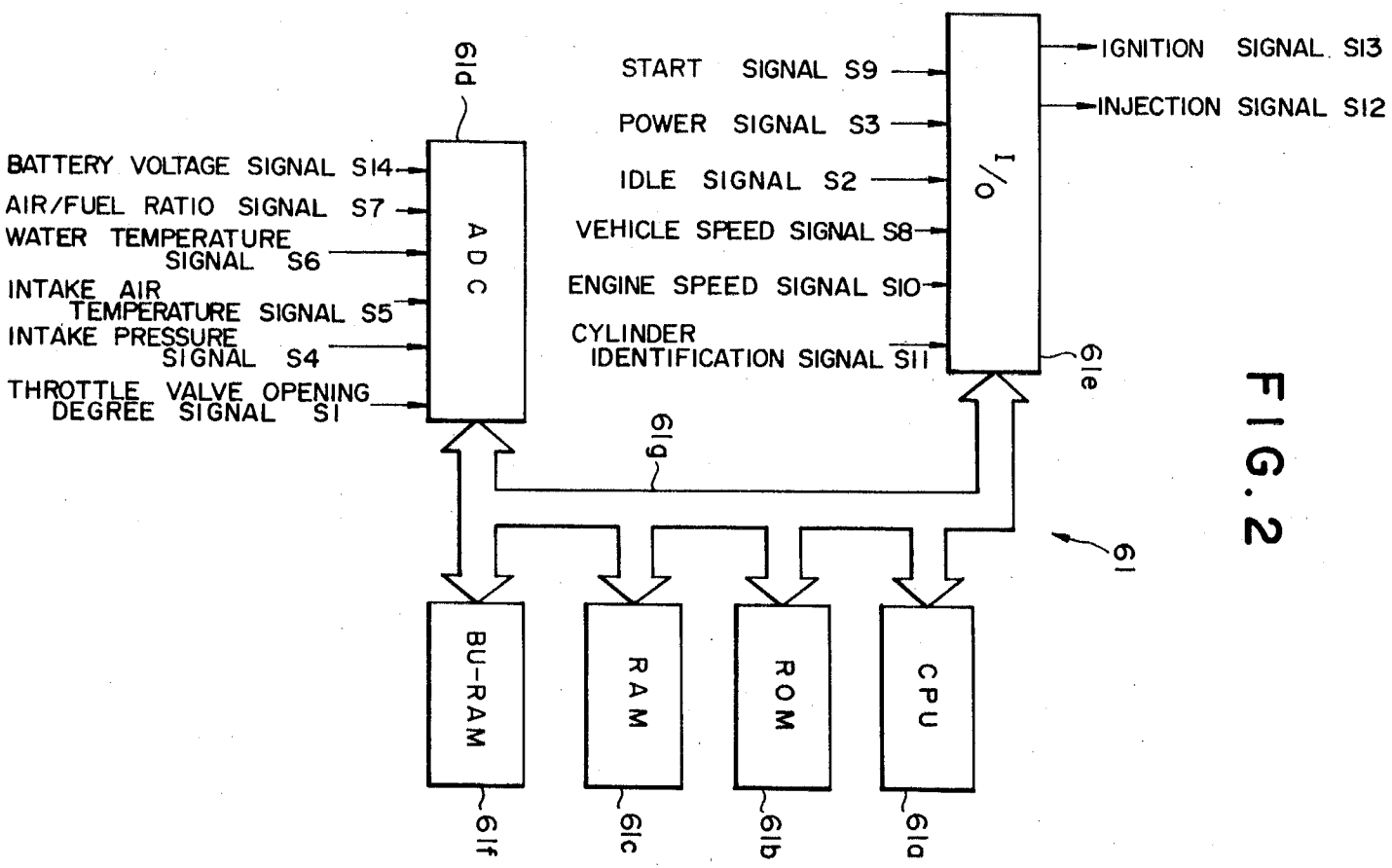
FIG. 2 is a detailed block diagram of an example of the control circuit.

As shown in FIG. 2, the control circuit 61 has the following parts or constituents: a central processing unit (CPU) 61*a* for controlling various devices; read only memory (ROM) 61*b* in which are written various numerical values and programs; a random access memory (RAM) 61*c* having regions in which are written numerical values obtained in the course of computation, as well as flags; an A/D converter (ADC) 61*d* for converting analog input signal into digital signals; an input.output interface (I/O) 61*e* through which various digital signals are inputted into and outputted from the control circuit; a backup memory (BU-RAM) 61*f* adapted to be supplied with electric power from an auxiliary power source when the engine is not operating thereby holding the contents of the memory; and a BUS line 61*g* through which these constituents are connected to one another. Programs which will be described in detail later are written in the ROM 61*b*.

Figure 3:
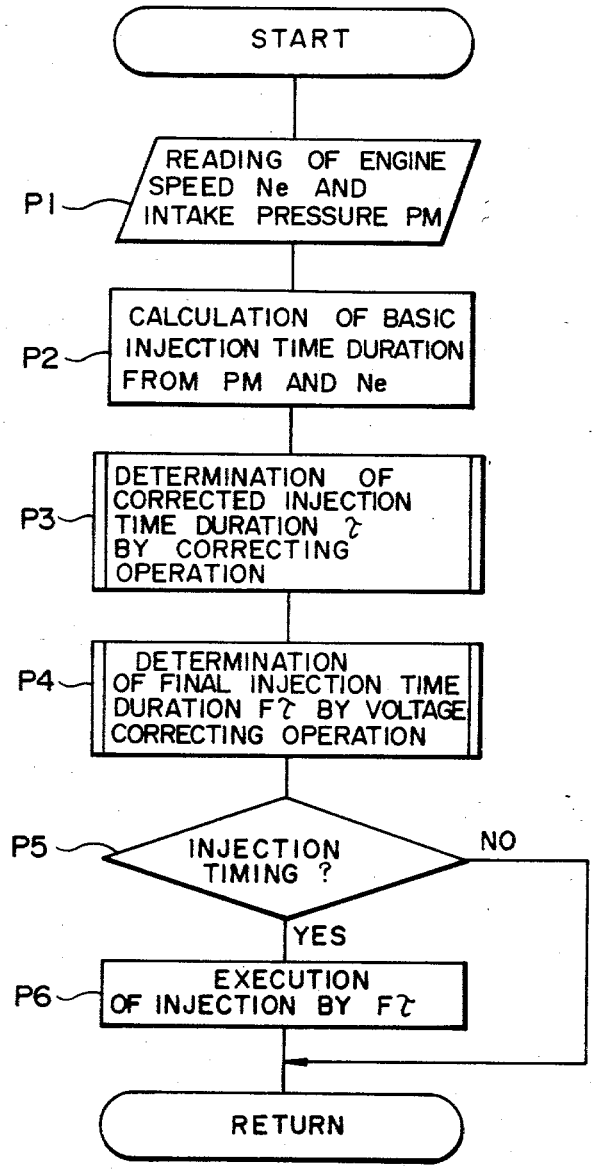
FIG. 3 is a flow chart of an example of the process for injecting the fuel.
Figure 4:
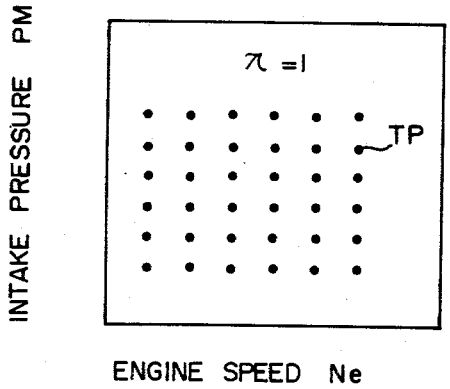
FIG. 4 is a diagram showing an example of a map from which the basic injection time TP is read from the engine speed Ne and the intake pressure PM.

In the operation of the engine described above, fuel is injected in accordance with the flow chart shown in FIG. 3. More specifically, in a step P1, the engine speed Ne is read in the form of the engine speed signal S1 which is the reference position signal. At the same time, the intake pressure PM is read in the form of an intake pressure signal S4. In a step P2, the basic injection time duration TP is read from the map shown in FIG. 4 using the read values of the engine speed Ne and the intake pressure PM. In a step P3, a corrected injection time duration $\tau$ is determined through a computation which is conducted in accordance with the operating condition of the engine.

A detailed description will be made hereinunder as to the process for computing the corrected injection time duration $\tau$ in the step P3.

The injection time duration $\tau$ is generally obtainable from the folowing formula.

$$\tau = TP \times FWL \times FAF \times (1 + FTC) \times FTHA \quad (1)$$

where,

Tp: basic injection time duration
FWL: warm-up incremental coefficient
FAF: air-fuel ratio feedback coefficient
FTC: transient air-fuel ratio correction coefficient
FTHA: intake air temperature correction coefficient.

Figure 5:
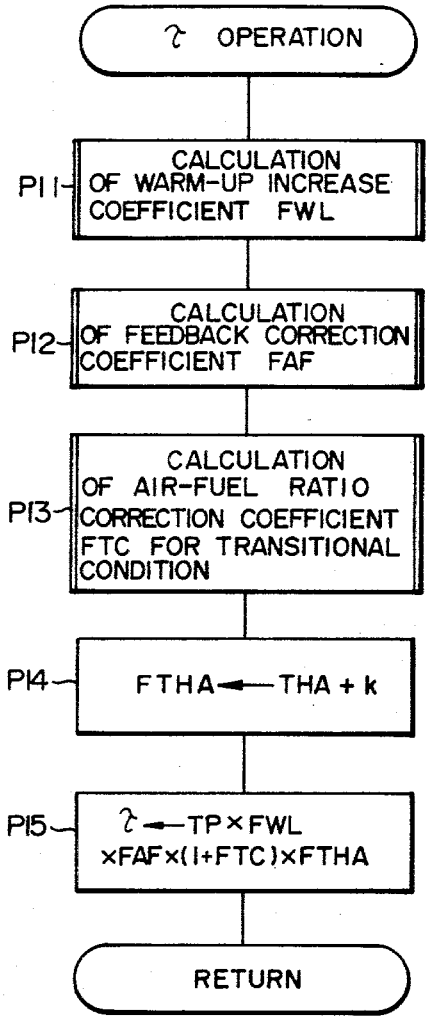
FIG. 5 is a flow chart showing an example of the process for determining the corrected fuel injection time duration.

These coefficients are calculated in accordance with the $\tau$ operation routine shown in FIG. 5 and the injection time duration $\tau$ is determined using these coefficients. Namely, in a step P11, a calculation is made to determine the warm-up incremetal coefficient FWL, whereas, in a step P12, a calculation is made to determine the air-fuel ratio feedback correction coefficient FAF. In the next step P13, a calculation is made to determine the air-fuel ratio correction coefficient FTC in the transient period. Subsequently, a calculation of (THA+k) is made to determine the correction coefficient FTHA in a step P14. Finally, the calculation of the above-mentioned formula (1) is made in a step P15 to determine the injection time duration $\tau$.

Before turning to the detailed explanation of calculation made in each of the steps P11 to P13, a description will be made as to an example of the routine for computing the start temperature correction value ADD and as to an example of the routine for processing the intake pressure PM, which are essential features of the first aspect of the present invention.

(Computation of Start Temperature Correction Value ADD)

Figure 7:
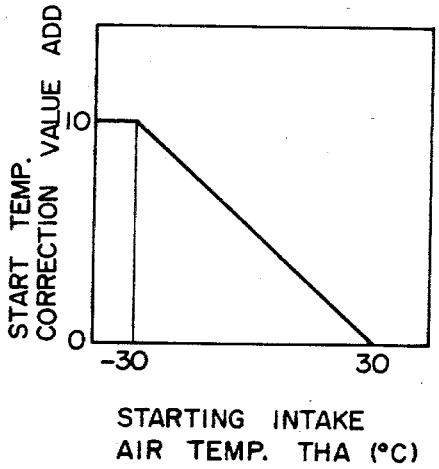
FIG. 7 is a graph showing the relationship between start intake air temperature THA and the start temperature correction value ADD.
Figure 6:
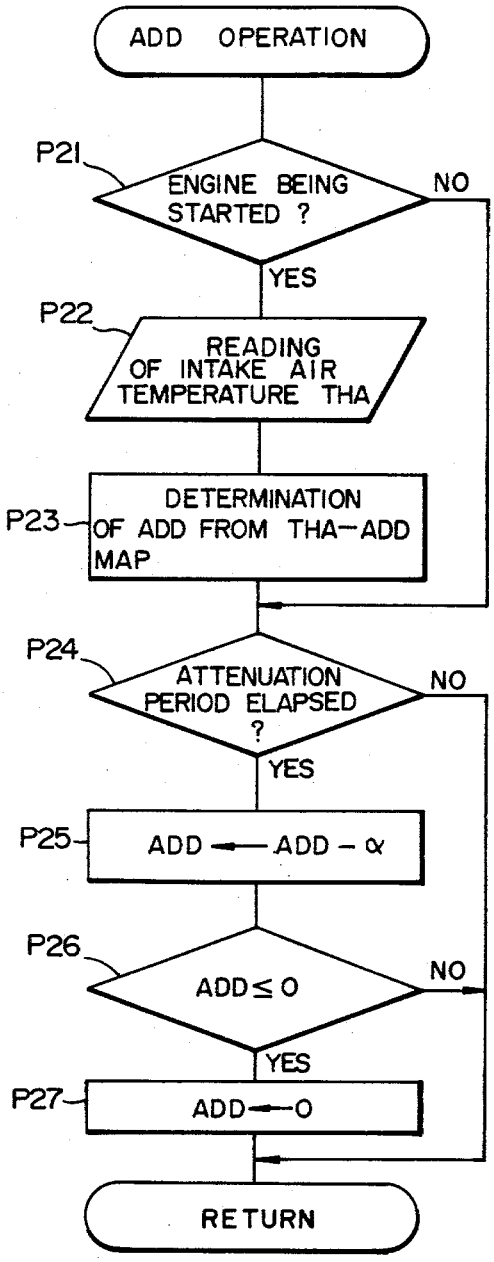
FIG. 6 is a flow chart showing an example of the process for determining start temperature correction value ADD.

FIG. 6 shows the routine for computing the correction value ADD. As this routine is started at a predetermined timing, a judgement is made in a step P21 as to whether the engine is being started, making use of the engine speed signal S10. If the answer is affirmative, i.e. if the engine is being started, the start intake air temperature THA is read as the engine start temperature, on the basis of the intake air temperature, signal S5. In the next step P23, the correction value ADD is read in accordance with the read value of the start intake air temperature THA, from the map written in the ROM 61*b*. As will be seen from FIG. 7, this map shows the relationship between the correction value ADD and the intake air temperature THA. Then, in a step P24, a judgement is made as to whether a predetermined period necessary for the attenuation of the correction value ADD by a pedetermined amount $\alpha$ has passed. If the answer is affirmative, the process proceeds to the next step P25. In this step P25, a value (ADD$-\alpha$) is made and the result is stored as a new correction value ADD in a predetermined storage region. A judgement is made in the next step P26 as to whether the correction value ADD is smaller than zero or not. If the answer is affirmative, the correction value is nullified, i.e. set at zero, in a step P27 and then the routine for the determination of the correction value ADD is completed. If the answer to the question in the step P26 is negative, the ADD computation routine skips over the step P27. If this routine is started after the starting up of the engine, a negative answer is made in response to the inquiry made in the step P21 and the process jumps directly to the step P24. If the answer in this step is affirmative, the steps P25 to P27 are taken as explained above. If the answer is negative, the process skips over the steps P25, P26 and P27 and the series of operation is completed.

Figure 8:
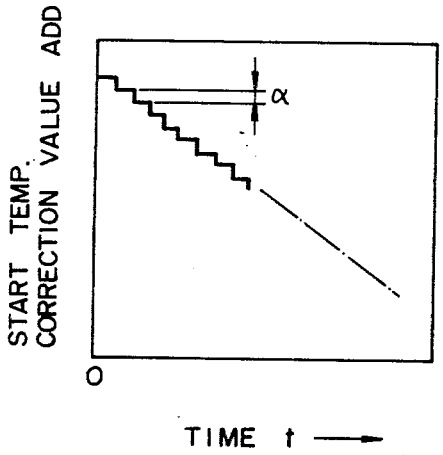
FIG. 8 is a graph showing the atenuation of the start temperature correction value ADD in relation to time.

As will be seen from the foregoing description, as well as from FIG. 8, the start temperature correction value ADD read on the basis of the intake air temperature THA at the time of starting up of the engine is attenuated at a constant rate $\alpha$ at a predetermined period.

(Computation of Intake Pressure PM)

Figure 9:
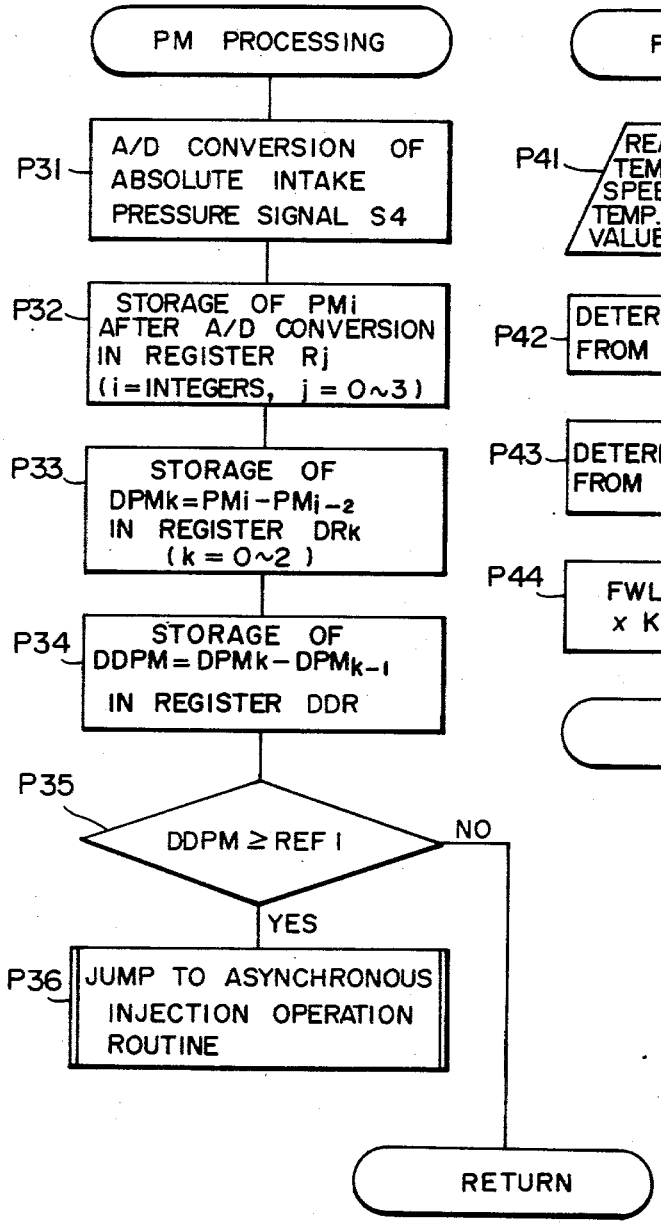
FIG. 9 is a flow chart showing an example of the process for processing of the intake pressure PM.
Figure 10:
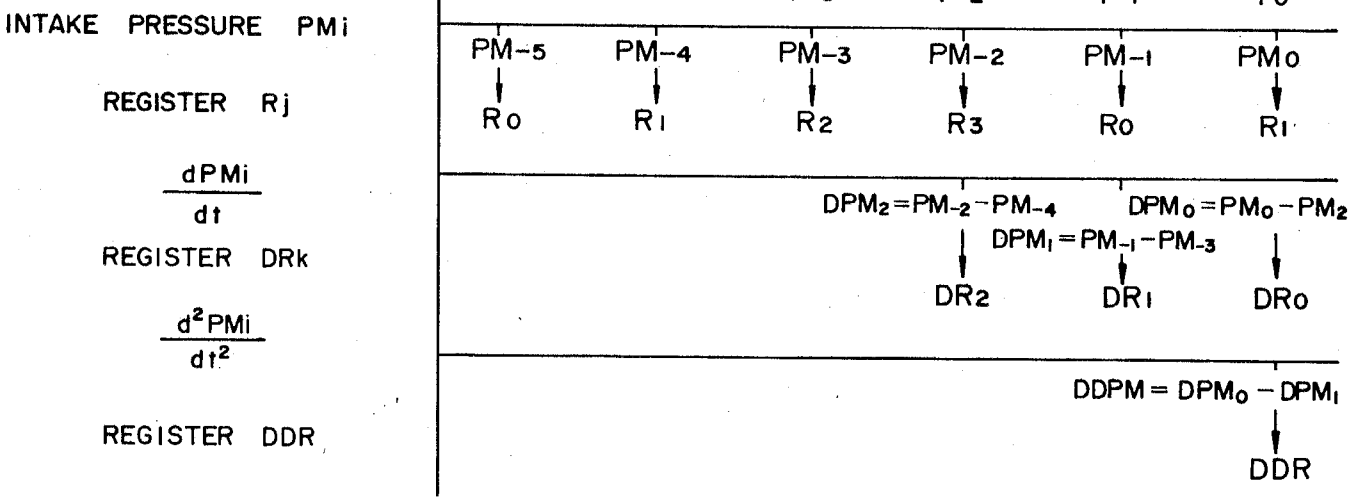
FIG. 10 is a diagram for explaining the steps of the process shown in FIG. 9.

The process for computing the intake air pressure PM shown in FIG. 9 is conducted repeatedly at a predetermined period as will be seen from FIG. 10. In a step P31, the absolute intake pressure signal S4 is converted into a digital signal. In the next step P32, the digital values PMi(i being an integer) are successively stored in regions Ro to R3 at a predetermined period. Then, the following computation is conducted in the following step P33. For instance, the intake pressure PM-4 which was stored in the register R1 at an instant (t−4) is subtracted from the intake pressure PM-2 stored in the register R1 at an instant (t−2). The result $DPM_2$ of this operation is stored in a register $DR_2$. Then, the process proceeds to the next step P34. In this step, at an instant $t_0$ for example, the value $DPM_1$ stored in the register $DR_1$ is subtracted from the value $DPM_0$ stored in the register $DR_0$, and the result DDPM of this calculation is stored in a register DDR as a second-order differentiation value. In the next step P35, the second-order differentiation value DDPM of the intake pressure stored in the register DDR is compared with a reference value REF 1. If the condition DDPM≧REF 1 is met, the process jumps to an asynchronous injection routine which will be explained later with reference to FIG. 22. On the other hand, this process is completed if the condition of DDPM<REF 1 is met.

Thus, the intake pressures PM stored in respective registers at every moment are used in the computation of the basic injection time duration TP. On the other hand, the first-order differentiation value DPM of the intake pressure PM is used in the computation of the synchronous acceleration incremental correction, while the second-order differentiation value DDPM is used in the computation for the asynchronous acceleration incremental correction.

An explanation will be made hereinunder as to the operations for determining the coefficients in respective steps of the process explained before in connection with FIG. 5.

(1) Computation of Warm-Up Incremental Coefficient FWL

Figure 11:
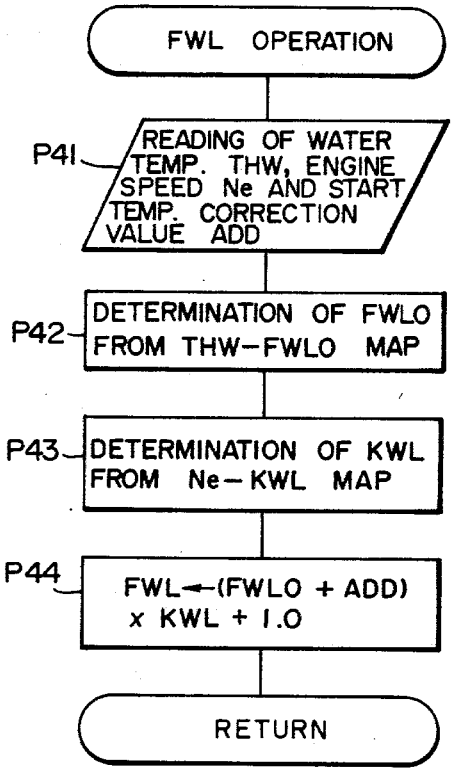
FIG. 11 is a flow chart showing an example of the process for computing the warm-up incremental coefficient FWL.
Figure 12:
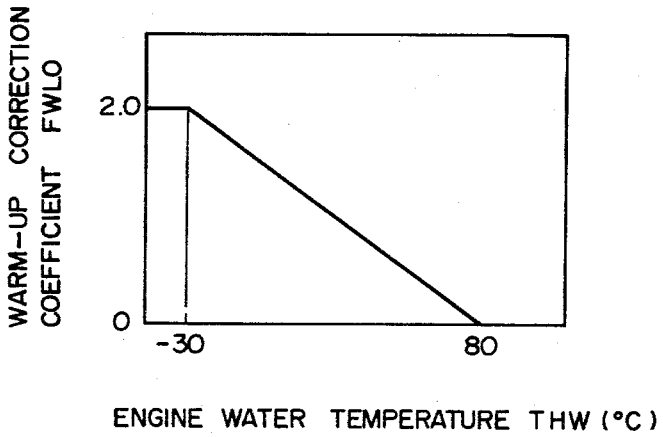
FIG. 12 is a graph showing the relationship between the cooling water temperature THW and the warm-up correction coefficient FWLO.
Figure 13:
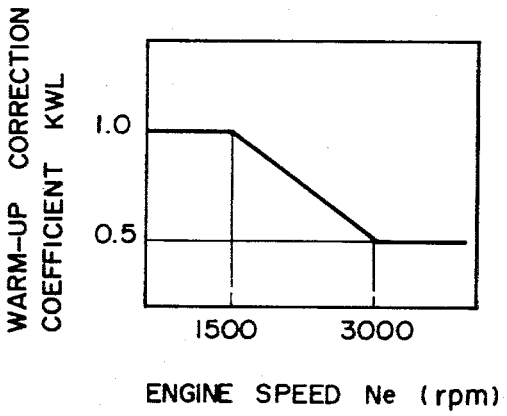
FIG. 13 is a graph showing the relationship beween the engine speed Ne and the warm-up correction coefficient KWL.

An example of the process for computing the warm-up incremental coefficient will be explained hereinunder with reference to FIG. 11. In a step P41, the cooling water temperature THW is read in the form of the water temperature signal S6. At the same time, the engine speed Ne is read on the basis of the engine speed signal S10. Furthermore, the correction value ADD computed in the routine shown in FIG. 6 is also read in this step. In a step P42, the correction coefficient FWLO is determined on the basis of the newest water temperature THW from a map (see FIG. 12) which shows the relationship between the correction coefficient FWLO and the cooling water temperature. In the subsequent step P43, the correction coefficient KWL is read on the basis of the newest engine speed Ne from a map (see FIG. 13) which shows the relationship between the engine speed Ne and the correction coefficient KWL. In a step P44, the following computation is executed to determine the warm-up incremental coefficient FWL to complete a series of operation.

$$\text{FWL} = (\text{correction coefficient FWLO} + \text{correction value ADD}) \times \text{correction coefficient KWL} + 1.0$$

(2) Computation of Feedback Correction Coefficient FAF

Figure 14:
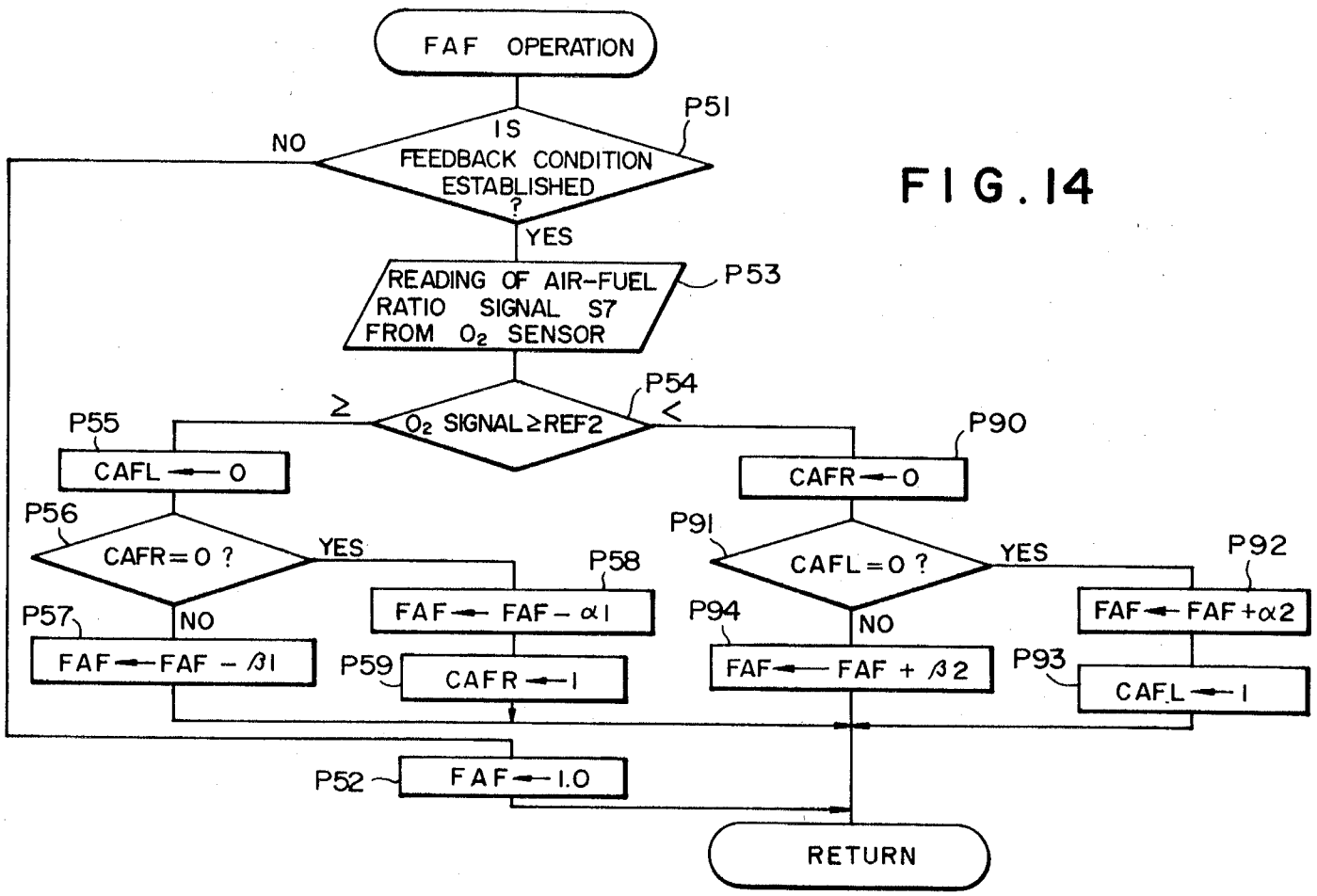
FIG. 14 is a flow chart showing an example of the process for computing feedback correction coefficient FAF.

An example of the process for computing the feedback correction coefficient FAF is shown in FIG. 14.

As the routine for computing the air-fuel ratio feedback correction coefficient FAF is started, a judgement is made in a step P51 to judge whether the feedback condition has been established. The condition for the feedback is established when all of the following requirements are met: engine is not being stated; engine is not in the fuel incremental condition after start up, cooling temperature is not lower than 40° C.; engine is not in the power incremental phase; and engine is not under lean control. If the condition for the feedback has not been established, the feedback correction coefficient FAF is set at 1.0 in the step P52 to prohibit feedback control, thereby completing this process. On the other hand, if the condition for the feedback has been established, the process proceeds to a step P53.

The air-fuel ratio signal S7 is read in the step P53. In a step P54, the voltage value of this air-fuel ratio signal is compared with a reference value REF2. When the level of the signal S7 exceeds or equals the reference value REF2, it is judged that the air-fuel ratio is too small, i.e. the mixture is too rich, and the process is started to increase the air-fuel ratio, i.e. to make the mixture more lean. Namely, after setting the flag CAFL at zero in a step P55, the process proceeds to a step P56 in which a judgement is made as to whether the flag CAFR is zero or not. The state of the flag CAFR is zero if the process has been shifted to the too rich side for the first time, so that the process proceeds to a step P58 in which a predetermined value $\alpha 1$ is subtracted from the correction coefficient FAF stored in the RAM 61C and the result of this calculation is used as new correction coefficient FAF. In the step P59, the flag CAFR is set to be 1. Therefore, if the air-fuel mixture is judged to be too rich in two successive judging cycles in the step P54, negative judgement is made without fail in the step P56 in the second cycle and the following judging cycles, so that the process proceeds to a step P57 in which a predetermined value $\beta 1$ is subtracted from the correction coefficient FAF. The result of this calculation is then determined as the new correction coefficient FAF, thus completing the FAF operation.

On the other hand, if the judgement in the step P54 proves the level of the signal S7 to be smaller than the reference value REF2, it is judged that the air-fuel ratio is too large, i.e. the mixture is too lean, so that a process is taken to decrease the air-fuel ratio, i.e. to make the mixture richer. More specifically, the process proceeds to a step P91 after setting the flag CAFR at zero in a step P90. In the step P91, a judgement is made as to whether the state of the flag CAFL is zero or not. If the process has been shifted to the too lean side for the first time, the process proceeds to a step P92 because the state of the flag CAFL is zero. In the step P92, a predetermined value $\alpha 2$ is added to the correction coefficient FAF and the result of this addition is used as the new FAF. In a step P93, the state of the flag CAFL is set to be 1. Therefore, if the mixture is judged to be too lean in two successive judging cycles, in the step P54, a negative judgement is made without fail in the second cycle and the following judging cycles in the step P91. Then, the process proceeds to a step P94 in which a predetermined value $\beta 2$ is added to the correction coefficient FAF and the result of this addition is determined as the new FAF, thus completing the FAF operation. The values $\alpha 1$, $\alpha 2$, $\beta 1$ and $\beta 2$ used in the steps P57, P58, P92 and P94 are the values which have been determined beforehand.

Figure 15:
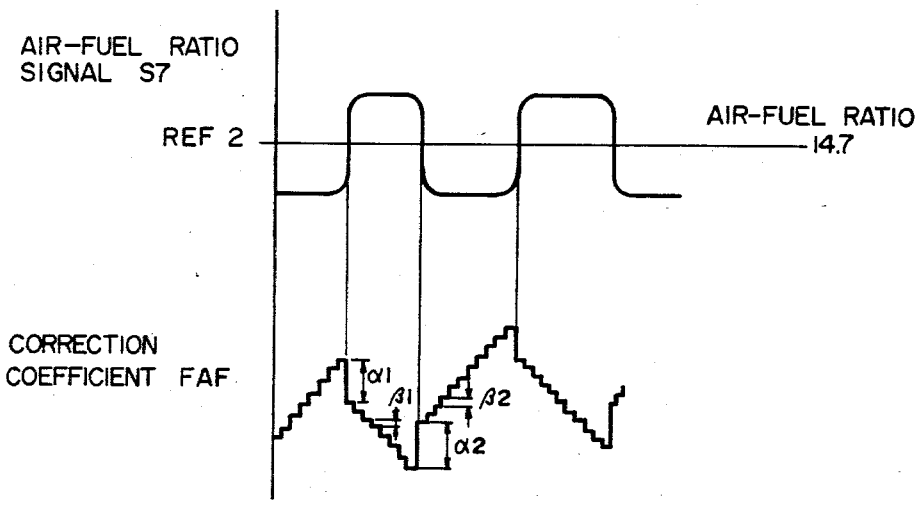
FIG. 15 is a time chart showing how the air-fuel ratio signal S7 and the correction coefficient FAF are changed in relation to time.

The feedback correction coefficient FAF determined through this operation is shown in FIG. 15 together with the air-fuel ratio signal S7. The following will be noted from this Figure. Namely, when the signal S7 rises above the reference value REF2 or drops below the same, the correction coefficient FAF is skipped by an amount $\alpha 1$ or $\alpha 2$. Thereafter, when the signal S7 exceeds the reference value, the predetermined value $\beta 1$ is subtracted successively, whereas, if the signal S7 is below the reference value, the predetermined value $\beta 2$ is added successively.

(3) Computation of Air-Fuel Ratio Correction Coefficient in Transient Period

Figure 16:
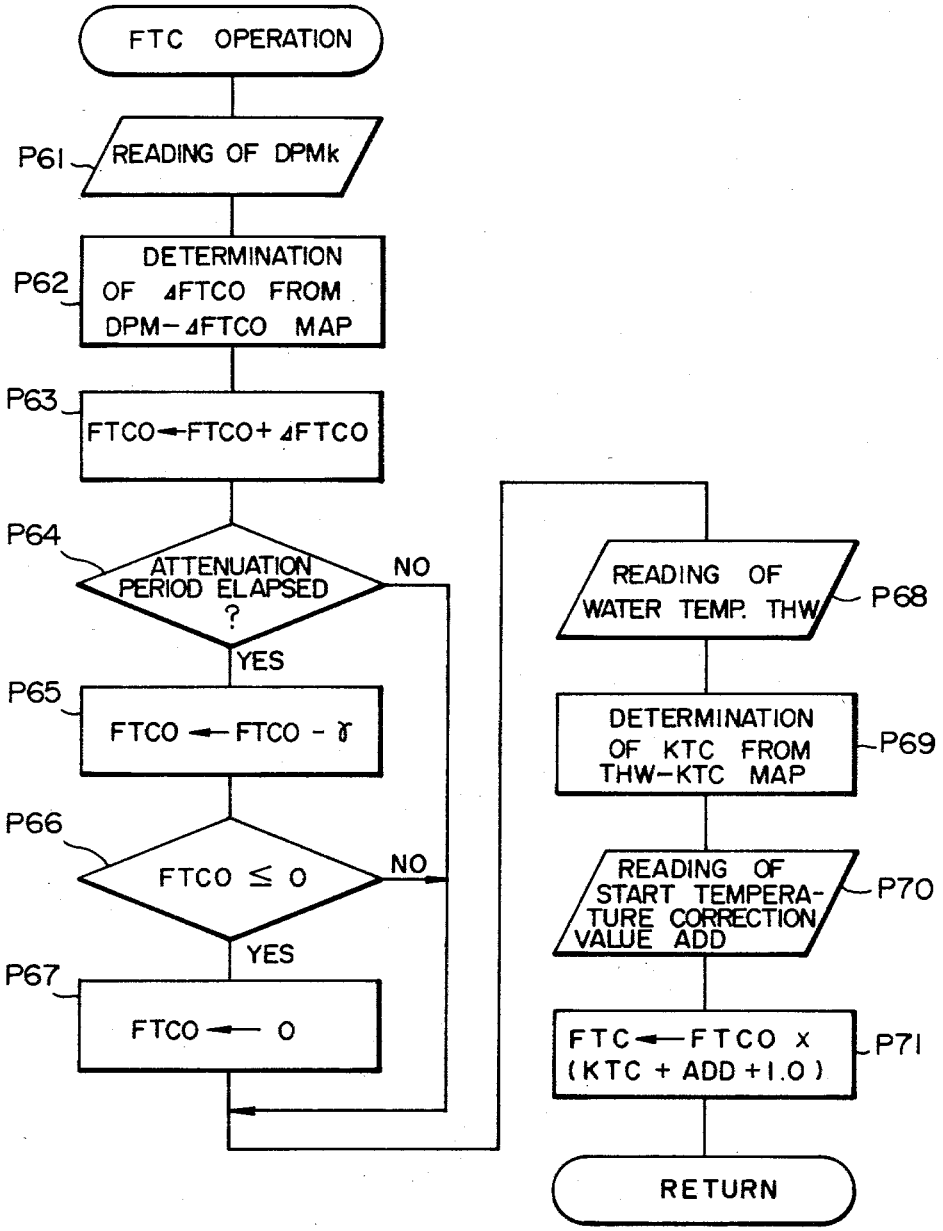
FIG. 16 is a flow chart showing an example of the computation of the warm-up acceleration incremental coefficient FTC.
Figure 17:
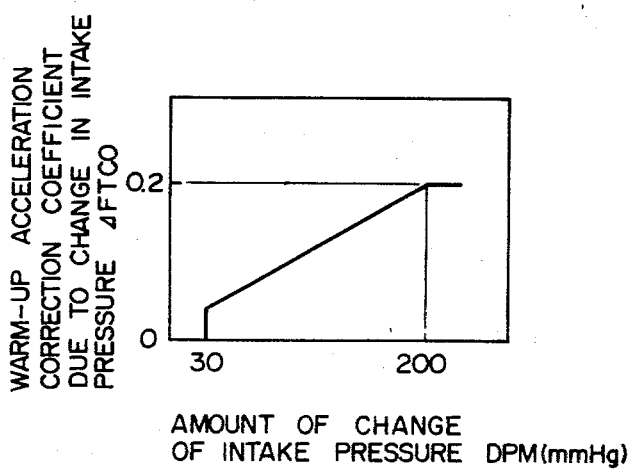
FIG. 17 is a graph showing the amount DPM of change in the intake pressure and the warm-up acceleration correction coefficient FTCO.

An explanation will be made hereinunder with specific reference to FIG. 16 as an example of the process for computing the air-fuel ratio correction coefficient FTC in the transient period. This process constitutes an essential feature of the second aspect of the invention. The amount $DPM_K$ of change of the intake pressure PM obtained through the routine shown in FIG. 9 is read in a step P61. Then, in a step P62, a warm-up acceleration correction coefficient ΔFTCO is determined using a map shown in FIG. 17. As will be seen from FIG. 17, this map shows the relationship between the amount $DPM_K$ of change in the intake pressure and the warm-up acceleration correction coefficient ΔFTCO. Then, in a step P63, the correction coefficient FTCO which has been determined beforehand is added to the correction coefficient ΔFTCO which is determined in the step P62. Using the result of this addition calculation as the new correction coefficient FTCO, the process proceeds to a step P64. In the step P64, a judgement is made as to whether a predetermined period for attenuation of the thus obtained correction coefficient FTCO by a predetermined amount $\alpha$ has elapsed. If the answer is affirmative, the process proceeds to a step P65. In the step P65, $(FTCO-\gamma)$ is calculated and the result of this calculation is stored in a predetermined storage region as a new correction coefficient FTCO. In the next step P66, a judgement is made as to whether the correction coefficient FTCO is smaller than or equal to zero. If the answer is affirmative, the process proceeds to a step P68 after setting the correction coefficient FTCO at zero in a step P67. The process jumps to the step P68 also when a negative answer is obtained in the step P64 or the step P66.

Figure 18:
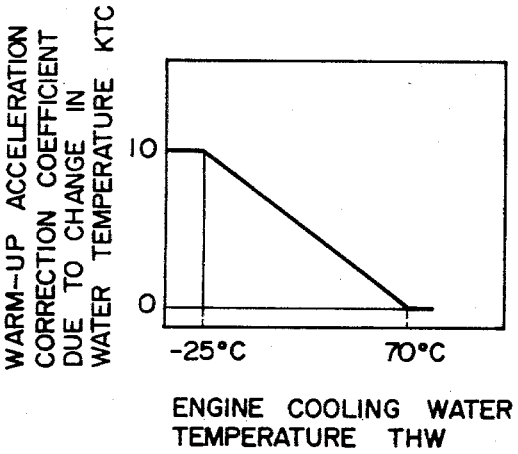
FIG. 18 is a graph showing the relationship between the cooling water temperature THW and the warm-up acceleration correction coefficient KTC.

In the step P68, the cooling water temperature THW is read on the basis of the water temperature signal S6. In a next step P69, the warm-up acceleration correction coefficient KTC is read from a map shown in FIG. 18, using the read value of the cooling water temperature THW. As will be seen from FIG. 18, this map shows the relationship between the cooling water temperature THW and the warm-up acceleration correction coefficient KTC. In a next step P70, the start temperature correction value ADD determined by the routine shown in FIG. 6 is read. The process then proceeds to a step P71 in which the following calculation is made to determine the warm-up acceleration correction coefficient FTC, using the correction coefficients FTCO, KTC and ADD which have been obtained as explained hereinbefore:

$$FTC=FTCO\times(KTC+ADD+1.0)$$

Figure 19:
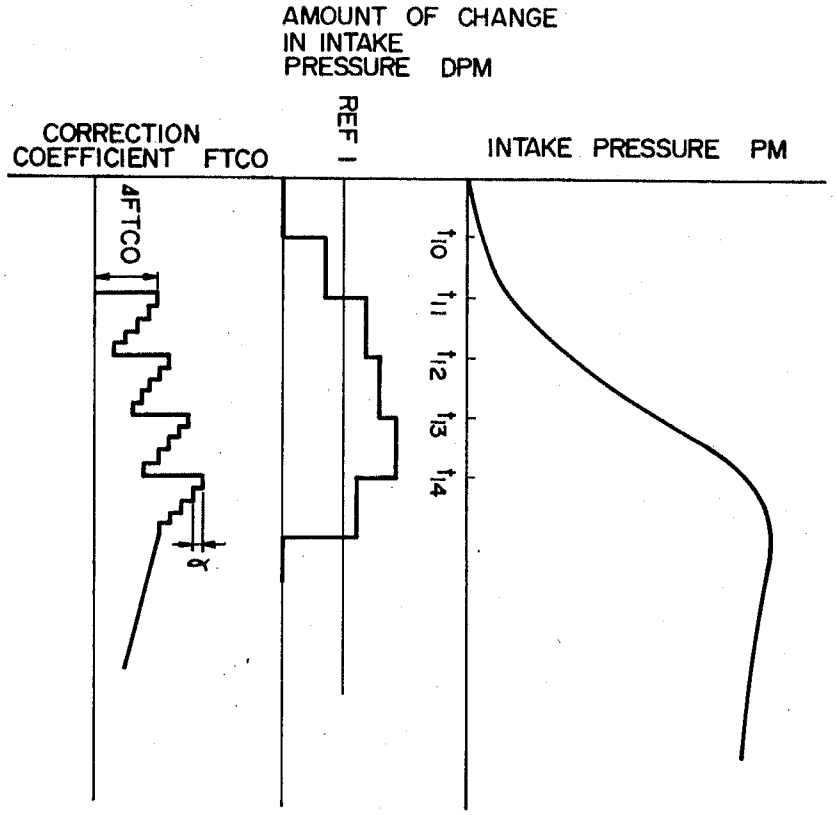
FIG. 19 is a time chart showing how the intake pressure PM, amount DPM of change of the intake pressure and correction coefficient FTCO are changed in relation to time.

The correction coefficient FTC obtained through the steps P61 to P65 is shown in FIG. 19 together with the intake pressure PM and the amount DPM of change in the intake pressure. The following will be noted from this Figure. Namely, in successive moments, a predetermined value ΔFTCO is added to FTCO at each time the amount DPM of change in intake pressure exceeds the reference value REF1. At the same time, in the period between successive moments, a value $\gamma$ is subtracted from the correction coefficient FTCO at a predetermined period.

The coefficients FWL, FAF and FTC used in the steps P11 to P13 of the process shown in FIG. 5 are determined in the manner described hereinbefore. Then, in a step P15, an operation is made in accordance with the following formula to determine the corrected injection time duration $\tau$: $t=TP\times FWL\times FAF\times(1+FTC)\times FTHA$. The process is then returned to the step P4 shown in FIG. 3.

Figure 20:
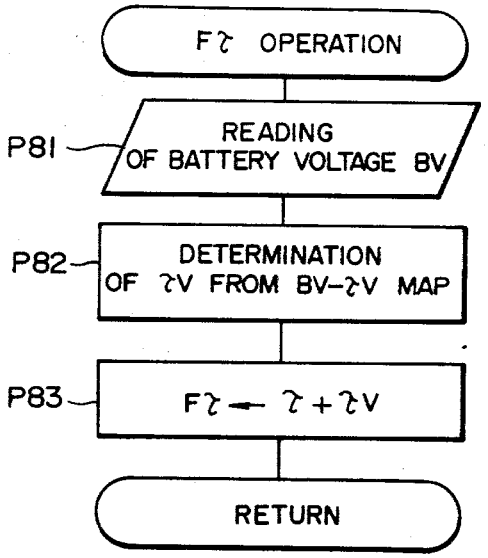
FIG. 20 is a flow chart showing an example of the computation of the final injection time duration $F\tau$.
Figure 21:
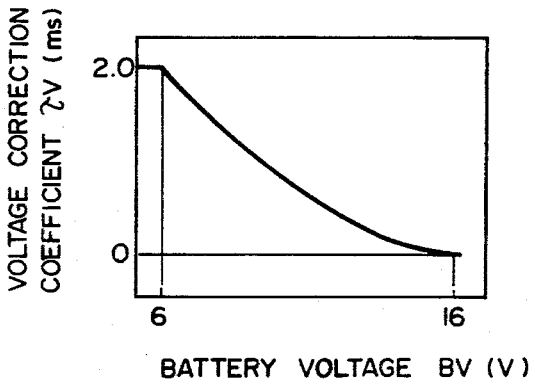
FIG. 21 is a graph showing the relationship between the battery voltage BV and voltage correction coefficient $\tau V$.

In FIG. 3 there is shown a computation for voltage compensation which is conducted in a step P4 using a voltage compensation computing routine as shown in FIG. 20. In a step P81, the battery voltage BV is read in accordance with the batery voltage signal S14. In a step P82, the voltage correction coefficient $\tau V$ is read from the map shown in FIG. 21 using the thus read battery voltage BV. As will be seen from FIG. 21, this map shows the relationship between the battery voltage BV and the voltage correction coefficient $\tau V$. In a step P83, a computation of $(\tau+\tau V)$ is executed to determine the final injection time duration F2. The process then returns to the step P5 shown in FIG. 3. If the instant moment coincides with the injection timing, an injection signal S12 is issued from the control circuit 61 to the injector 7, thereby driving the latter.

In the process shown in FIG. 5, the intake air temperature correction FTHA in the step P14 is conducted to compensate for the variation of the density of the intake air due to a change in the air temperature.

An explanation will be made hereinunder as to the asynchronous injection computing routine which constitutes an essential feature of the third aspect of the invention.

Figure 23:
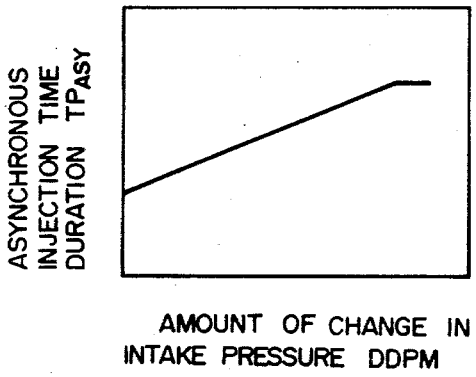
FIG. 23 is a graph showing the relationship between the amount DDPM of change in the intake pressure and the asynchronous injection time duration $TP_{ASY}$.
Figure 22:
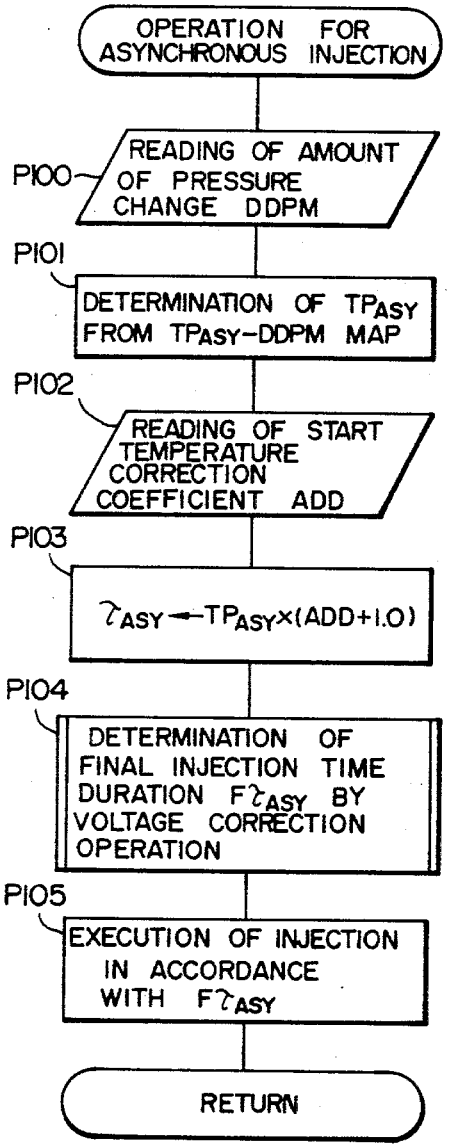
FIG. 22 is a flow chart showing an example of the computation of asynchronous injection.

The routine shown in FIG. 22 is started by a jump from the step P36 shown in FIG. 9. In a step P100, the amount of the change in the pressure, which is stored in a register DDR, is read and the process proceeds to a step P102. In the step P102, an asynchronous injection time duration $TP_{asy}$ is read from a map shown in FIG. 23, making use of the thus read pressure changing amount DDPM. As will be seen from FIG. 23, this map shows the relationship between the changing amount DDPM of the intake pressure and the asynchronous injection time duration $TP_{ASY}$. Then, after reading the newest start temperature correction value ADD calculated through the routine shown in FIG. 6, the process proceeds to a step P103. In the step P103, a computation of $(TP_{ASY}\times(ADD+1.0))$ is executed to store the result in a predetermined storage region. On the other hand, in a step 104, a correction processing in accordance with the battery voltage is executed to determine the final asynchronous injection time duration $F\tau_{ASY}$.

Figure 24:
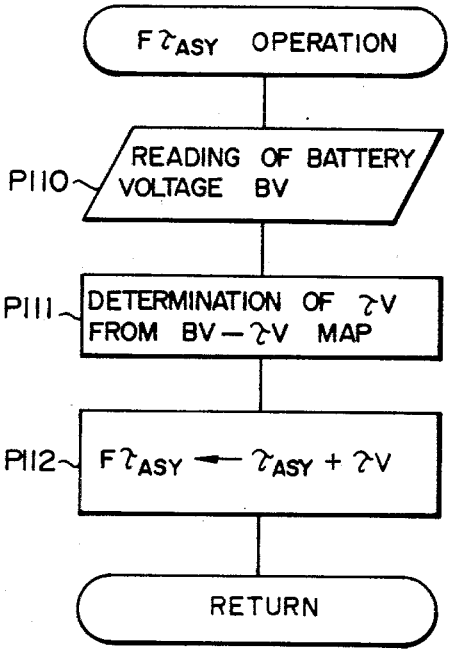
FIG. 24 is a flow chart showing an example of the computation of the final injection time duration $F\tau_{ASY}$.

FIG. 24 shows an example of the routine for computing the asynchronous injection time duration $F\tau_{ASY}$. First of all, in a step P110, the battery voltage BV is read in terms of the battery voltage signal S14. Then, in the next step P111, a voltage correction coefficient $\tau V$ is read from a map shown in FIG. 21, using the thus read battery voltage BV. As will be seen from FIG. 21, this map shows the relationship between the battery voltage BV and the voltage correction coefficient $\tau V$. The process then proceeds to a step P112 in which a computation of $(\tau_{ASY}+\tau V)$ is made to determine the final asynchronous injection time duration $F\tau_{ASY}$. After storing this value in a predetermined storage region, the process is returned to a step 105 shown in FIG. 22.

In the step P105, an injection signal S12 is delivered to the injector 7 in accordance with the thus determined final asynchronous injection time duration $F\tau_{ASY}$, thereby conducting the asynchronous injection.

In the embodiments described hereinbefore, the intake pressure is used as the index of the degree of the engine acceleration. However, it is possible to use the amount of change of the opening degree of the intake throttle valve or amount of change of the intake air per revolution of the engine shaft as the index of degree of the engine acceleration. The selection of the start temperature compensation value ADD can be made in accordance with the temperature THW of the cooling water, engine oil or the cylinder block at the time of start up of the engine, although in the described embodiments the same is conducted in accordance with the intake air temperature at the time of start up of the engine.

In the described embodiment, the basic injection time duration TP is determined in accordance with the engine speed and the intake pressure. This, however, is not exclusive and the basic injection time duration can be determined in accordance with the engine speed and the flow rate of intake air. Furthermore, in the described embodiment, the engine speed is taken into account in the determination of the warm-up incremental coefficient FWL. This, however, is not exclusive and the warm-up incremental coefficient FWL can be determined without taking the engine speed into account.

What is claimed is:

1. A method of controlling the fuel injection rate in an internal combustion engine, said internal combustion engine having a fuel injector provided at a throttle body, having a throttle valve, said fuel injector being adapted to inject a fuel into an intake passage so as to be mixed with intake air in said intake passage, thereby forming an air-fuel mixture for induction into a combustion chamber of said engine along said intake passage, said method comprising the steps of:

computing, in accordance with the engine speed and the load on the engine, a basic injection time duration TP for injecting said fuel in synchronism with a crank rotation engine; and correcting said basic injection time duration TP during warming up of said engine by using, at least a warm-up correction coefficient FWL which is determined in accordance with an engine coolant temperature detected during the operation of said engine and a start temperature correction value ADD which is selected in accordance with an intake air temperature detected substantially at the time of start up of said engine and attenuated thereafter in accordance with the time elapsed after the start up of said engine.

2. A method according to claim 1, wherein said start temperature correction value ADD becomes greater as the intake air temperature, substantially at the time of start up of the engine, gets lower.

3. A method according to claim 2, wherein said step of correcting said basic injection time duration TP comprises the steps of:

determining a correction coefficient FWLO in accordance with engine coolant temperature, said correction coefficient FWLO becoming greater as the engine coolant temperature gets lower;

determining a correction coefficient KLW in accordance with the engine speed such that, said correction coefficient KWL becomes greater as the engine speed gets lower;

computing said warm-up correction coefficient FWL by the following formula;

$$FWL=(FWLO+ADD)\times KWL+1.0$$

and;

correcting said basic injection time duration TP by at least the following formula so that an injection time duration $\tau$ is determined;

$$\tau=TP\times FWL.$$

4. An apparatus for controlling the fuel injection rate in an internal combustion engine, said internal combustion engine having a single fuel injector provided at a throttle body, having a throttle valve, said single fuel injector being adapted to inject a fuel into an intake passage so as to be mixed with intake air in said intake passage, thereby forming an air-fuel mixture for induction into a combustion chamber of said engine along said intake passage, said apparatus comprising:

(a) start detecting means for detecting the engine being started up;

(b) an intake air temperature detecting means provided at the intake passage for detecting intake air temperature;

(c) an engine coolant temperature detecting means for detecting engine coolant temperature;

(d) an engine speed detecting means for detecting engine speed;

(e) a load detecting means for detecting engine load;

(f) a first memory means for storing a start temperature correction value ADD corresponding to the intake air temperature at the time of start up of said engine;

(g) a second memory means for storing a correction coefficient FWLO corresponding to the engine coolant temperature during the operation of said engine;

(h) a computing means for computing a basic injection time duration TP in accordance with the engine speed detected by said engine speed detecting means and the load detected by said load detecting means;

(i) a first storage means for storing the intake air temperature detected by said intake air temperature detecting means while said start detecting means is detecting that the engine is being started;

(j) a subtracting means for subtracting a predetermined amount, in accordance with time elapsed after the starting of said engine, from said start temperature correction value ADD read out from said first memory means on the basis of the intake air temperature stored in said first storage means;

(k) a second storage means for storing the latest subtraction result from said subtracting means;

(l) a third storage means for storing the latest engine coolant temperature detected by said engine coolant temperature detecting means during the operation of said engine;

(m) a correcting means for correcting said basic fuel injection time duration TP in accordance with said start temperature correction value ADD which has been read from said second storage means and said correction coefficient FWLO which has been read from said second memory means on the basis of said engine coolant temperature read from said third storage means; and (n) means for outputting an injection signal for driving said injector for a time duration corrected by said correcting means.

5. An apparatus according to claim 4, wherein said single fuel injector is disposed at an upstream portion of the throttle valve.

6. An apparatus according to claim 5 wherein said start temperature correction value ADD becomes greater as the intake air temperature, substantially at the time of the engine start up, gets lower.

7. An apparatus according to claim 6, wherein a warm-up correction coefficient FWL is determined, in accordance with said correction coefficient FWLO, determined such that the correction coefficient FWLO becomes greater as the engine coolant temperature gets lower, a correction coefficient KWL, determined such that the correction coefficient KWL becomes greater as the engine speed gets lower, and said start temperature correction value ADD, by the following formula;

$$FWL=(FWLO+ADD)\ KWL+1.0$$

and said basic fuel injection time duration TP is corrected by the following formula so that an injection time duration $\tau$ is determined;

$$\tau=TP\times FWL.$$

8. A method of controlling the fuel injection rate in an internal combustion engine, said internal combustion engine having a fuel injector provided at a throttle body, having a throttle valve, said fuel injector being adapted to inject a fuel into an intake passage so as to be mixed with intake air in said intake passage, thereby forming an air-fuel mixture for induction into a combustion chamber of said engine along said intake passage, said method comprising the steps of:

computing, in accordance with the engine speed and the load on the engine, a basic injection time duration TP for injecting said fuel in synchronism with a crank rotation angle; and correcting said basic injection time duration TP during acceleration of said engine while the engine is being warmed up, by using, at least, a start temperature correction value ADD which is selected in accordance with an intake air temperature at substantially the time of start up of said engine, said correction value ADD being attenuated thereafter in accordance with the time elapsed after start up of said engine, a first warm-up acceleration correction coefficient FTCO selected in accordance with the degree of acceleration of said engine, and a second warm-up correction coefficient KTC selected in accordance with an engine coolant temperature detected during the operation of said engine.

9. A method according to claim 8, wherein said start temperature correction value ADD becomes greater as the intake air temperature gets lower, said first warm-up acceleration correction coefficient FTCO becomes greater as the degree of acceleration gets greater and said second warm-up acceleration correction coefficient KTC becomes greater as the engine coolant temperature gets lower.

10. A method according to claim 9, wherein said basic injection time duration TP is corrected by using an air-fuel ratio correction coefficient FTC in a transient period which is indicated by (FTCO×(KTC+ADD+1.0)), so that an injection time duration $\tau$ is determined by the following formula:

$$\tau=TP\times(FTC+1.0).$$

11. A method according to claim 10, wherein said acceleration is detected by detecting variation of intake pressure in the intake passage.

12. An apparatus for controlling the fuel injection rate in an internal combustion engine, said internal combustion engine having a single fuel injector provided at a throttle body, having a throttle valve, said fuel injector being adapted to inject a fuel into an intake passage so as to be mixed with intake air in said intake passage, thereby forming an air-fuel mixture which is then induced into a combustion chamber of said engine along said intake passage, said apparatus comprising:

(a) start detecting means for detecting the engine being started up;

(b) an intake air temperature detecting means provided at the intake passage for detecting the intake air temperature;

(c) an engine coolant temperature detecting means for detecting an engine coolant temperature;

(c) an engine speed detecting means for detecting the engine speed;

(e) a load detecting means for detecting the engine load;

(f) an acceleration detecting means for detecting the accelerating condition of said engine;

(g) a first memory means for storing a start temperature correction value ADD corresponding to the intake air temperature at the time of start up of said engine;

(h) a second memory means for storing a first warm-up acceleration correction coefficient FTCO corresponding to the condition of acceleration of said engine;

(i) a third memory means for storing a second warm-up acceleration correction coefficient KTC corresponding to the engine coolant temperature during the operation of said engine;

(j) a computing means for computing a basic injection time duration TP in accordance with the engine speed detected by said engine speed detecting means and the load detected by said load detecting means;

(k) a first storage means for storing the intake air temperature detected by said intake air temperature detecting means while said start detecting means is detecting that the engine is being started;

(l) a subtracting means for subtracting a predetermined amount, accordance with the time elapsed after the starting of said engine, from said start temperature correction value ADD read out from said first memory means on the basis of the intake air temperature stored in said first storage means;

(m) a second storage means for storing the latest subtraction result from said subtracting means;

(n) a third storage means for storing the latest acceleration of said engine, detected by said acceleration detecting means;

(o) a fourth storage means for storing the latest engine coolant temperature; detected by said engine coolant temperature detecting means during the operation of said engine;

(p) a correcting means for correcting the basic fuel injection time duration TP in accordance with said start temperature correction value ADD which is read out from said second storage means, said first warm-up acceleration correction coefficient FTCO which is read out from said second memory means on the basis of the condition of acceleration of said engine read out from said third storage means, and said second warm-up acceleration correction coefficient KTC which is read out from said third memory means on the basis of said engine coolant temperature read out from said fourth storage means; and (q) a means for producing an injection signal for driving said fuel injector for a time duration corrected by said correction means.

13. An apparatus according to claim 12, wherein said single fuel injector is disposed at an upstream portion of the throttle valve.

14. An apparatus according to claim 12, wherein said start temperature correction value ADD becomes greater as the intake air temperature gets lower, said first warm-up acceleration correction coefficient FTCO becomes greater as the degree of acceleration gets greater and said second warm-up acceleration correction coefficient KTC becomes greater as the engine coolant temperature gets lower.

15. An apparatus according to claim 14, wherein said basic injection time duration TP is corrected by using an air-fuel ratio correction coefficient FTC in a transient period which is indicated by (FTCO×(KTC+ADD+1.0)), so that an injection time duration $\tau$ is determined by the following formula:

$$\tau = TP \times (FTC + 1.0).$$

16. An apparatus according to claim 15, wherein said acceleration detecting means comprises:

means for detecting an intake pressure in the intake passage; and means for determining a variation of said intake pressure, successively detected by said intake pressure detecting means.

17. A method of controlling the asynchronous fuel injection rate in an internal combustion engine, said internal combustion engine having a fuel injector provided at a throttle body, having a throttle valve, said fuel injector being adapted to inject a fuel into an intake passage so as to mixed with intake air in said intake passage, thereby forming an air-fuel mixture for induction into a combustion chamber of said engine along said intake passage, said method comprising the steps of:

determining a start temperature correction value ADD which is selected on the basis of the intake air temperature at the time of or immediately after the start up of said engine and attenuated in accordance with the time elapsed after the start up of said engine, such that, the lower the engine temperature is at the time of start up, the greater said start temperature correction value is; and controlling the rate TPasy of asynchronous fuel injection conducted asynchronously with the crank rotation angle, in accordance with both of said start temperature correction value ADD and the acceleration of said engine.

18. A method according to claim 17, wherein said asynchronous fuel injection rate TPasy is corrected by the following formula, so that an asychronous fuel injection rate $\tau$asy is determined:

$$\tau asy = TPasy \times (ADD + 1.0).$$

19. A method according to claim 18, wherein said acceleration is detected by detecting intake pressure in the intake passage so that variation of the intake pressure is computed, which is compared with a reference variation of the intake pressure, whereby when said variation is greater than the reference variation, said asynchronous fuel injection is conducted.

20. A method according to claim 19, wherein said asynchronois fuel injection rate TPasy becomes greater as said variation of the intake pressure gets greater.

21. An apparatus for controlling the asynchronous fuel injection rate in an internal combustion engine, said internal combustion engine having a single fuel injector provided at a throttle body, having a throttle valve, said single fuel injector being adapted to inject a fuel into an intake passage so as to be mixed with intake air in said intake passage, thereby forming an air-fuel mixture for induction into a combustion chamber of said engine along said intake passage, said apparatus comprising:

(a) start detecting means for detecting the engine being started up;

(b) an intake air temperature detecting means for detecting the intake air temperature;

(c) an acceleration detecting means for detecting an amount of acceleration of said engine;

(d) a first memory means for storing a start temperature correction value ADD which corresponds to the intake air temperature at the time of start up of said engine and takes a greater value as said intake air temperature becomes lower;

(e) a second memory means for storing asynchronous injection time duration TPasy corresponding to the amount of acceleration of said engine;

(f) a first storage means for storing the engine start temperature detected by said intake air temperature detecting means when said start detecting means is detecting that said engine is being started;

(g) a subtracting means for subtracting a predetermined amount, in accordance with the time elapsed after the start up of said engine, from said start temperature correction value ADD which is read out from said first memory means on the basis of said intake air temperature stored in said first storage means;

(h) a second storage means for storing the latest subtraction result from said subtracting means;

(i) a third storage means for storing the latest engine acceleration detected by said acceleration detecting means;

(j) a correcting means for correcting, in accordance with said start temperature correction value ADD read out from said second storage means, the rate of asynchronous fuel injection which is read out of said second memory means in accordance with the amount of acceleration of said engine read out from said third storage mans; and (k) a means for producing an asynchronous injection signal for driving said fuel injector for a time duration corrected by said correcting means.

* * * * *